US005743432A

United States Patent [19]

Barbe

[11] Patent Number: 5,743,432

[45] Date of Patent: Apr. 28, 1998

[54] LIQUID DISPENSING SYSTEM

[75] Inventor: David J. Barbe, Winterville, N.C.

[73] Assignee: U.N.X. Incorporated, Greenville, N.C.

[21] Appl. No.: 853,224

[22] Filed: Mar. 13, 1997

Related U.S. Application Data

[62] Division of Ser. No. 497,604, Jun. 30, 1995, Pat. No. 5,628,430.

[51] Int. Cl.[6] ..... B67D 5/64

[52] U.S. Cl. ..... 222/1; 222/132; 222/135; 222/382; 222/464.3

[58] Field of Search ..... 141/251, 263, 141/374; 222/132, 135, 173, 255, 265, 278, 325, 382, 464.3, 464.1, 1

[56] References Cited

U.S. PATENT DOCUMENTS

| | | | |
|---|---|---|---|
| 2,344,005 | 3/1944 | Sundholm | 222/382 |
| 2,539,615 | 1/1951 | Fox et al. | 222/135 |
| 4,247,018 | 1/1981 | Credle | 222/1 |
| 5,059,954 | 10/1991 | Beldham et al. | 340/614 |
| 5,238,146 | 8/1993 | Thorne, Jr. | 222/382 X |

*Primary Examiner*—Kenneth Bomberg
*Attorney, Agent, or Firm*—Olive & Olive, P.A.

[57] ABSTRACT

A liquid dispenser for withdrawing liquids from one or more containers having a mouth and bottom and side walls joined at a juncture comprised of a container support to position the containers with their mouths over the lowermost part of the wall juncture, a probe support spaced above the container support, and a plurality of probes slidably supported on the probe support above the container support, each probe including a lower end with a curved face corresponding to the curvature of the juncture, each probe being moveable between a raised position above the mouth of a container, and a lowered position extending through the mouth of the container and into contact with the lowermost part of the interior of said container at the juncture, and a pump to draw liquid from the container upwardly through the probe.

2 Claims, 3 Drawing Sheets

LIQUID DISPENSING SYSTEM

This application Ser. No. 08/853,224 is a divisional application of prior application Ser. No. 08/497,604, filed Jun. 30, 1995 now U.S. Pat. No. 5,628,430.

BACKGROUND OF THE INVENTION

The present invention relates to an improved apparatus and method for removing liquid from a container, and in particular to an apparatus and method for dispensing chemicals, such as liquid chemicals for use in commercial laundry systems, from a plurality of containers, whereby substantially all of the liquid in the containers is withdrawn during dispensing.

Liquids may be provided to the end user in several different types of containers, holding from one gallon or less up to about 55 gallons. Some of these containers are of blow molded plastic and have a circular bottom wall, a continuous side wall extending upwardly from the periphery of the bottom wall, and an upper wall including a mouth or opening for removal of the liquid. With smaller containers holding up to 5 gallons, the side wall may taper inwardly at its upper end to form an upper wall with a centrally located mouth. The mouth is normally covered by a screw cap that is removed when the container is positioned for dispensing. Other blow molded containers holding up to 2 gallons may have a rectangular or oval shape, such as the shape of a conventional anti-freeze container.

Small quantities, e.g., up to 5 gallons, of liquid chemicals are also packaged in bag-in-box containers comprised of a cardboard box enclosing a flexible, blow molded, plastic liner. The liner includes a mouth or opening that protrudes from an opening in the top of the box when liquid is to be dispensed, and is recessed into the box during shipping. The box opening may be offset, i.e., located closer to one side wall than the other side walls, to facilitate pouring.

In operating commercial laundry machines, containers filled with liquid laundry chemicals, e.g. detergents fabric softeners, bleach, etc., are placed in the vicinity of the washing machines, and liquids are pumped from the various containers in response to signals from the washing machines. Normally, chemicals are removed by placing the containers on a horizontal surface and inserting a rigid robe or probe into the mouth of the container by hand. The probe will usually be positioned in a random manner. Often, the probe will extend substantially vertically down into the container. Since the bottom wall of most detergent containers is concave to ensure that the container rests firmly on the surface, a probe inserted vertically into the container will rest on the upper surface of the central concave portion of the bottom wall. As a result, the liquid at the juncture of the side and bottom walls of the container, i.e., the lowest part of the container interior, will not be accessible to the probe.

Even if the probe is inserted at an angle into the container, it may not be long enough to extend completely to the juncture of the side and bottom walls, or the distal end of the probe will be of a configuration such that all of the liquid will not be removed. Conventionally, the ends of probes are cut at an angle. Thus, when the liquid level is lowered to the top of the probe opening air is drawn into the probe, leaving a portion of the liquid still within the container.

U.S. Pat. No. 5,238,146 to Thorne, Jr., describes a technique for reducing the amount of liquid left in drums by tilting the drums with an insert to be placed under one edge of the drum. A probe or suction tube is then inserted vertically through an opening in the top of the drum so that the lower end of the probe is adjacent the juncture of the bottom and side walls of the drum, permitting removal of a greater portion of the liquid. Since the probe is inserted into the drum by hand, there is no assurance that the lower end of the probe will engage the lowermost portion of the drum interior. Moreover, the probe may shift during pumping. Even if the end of the probe happens to extend all the way in the lowermost portion of the drum, all of the liquid will not be removed since the end configuration of the probe will permit the entry of air into the probe before complete removal of the liquid.

Thus, in prior procedures, removal of liquid from containers using a probe or suction tube has resulted in a small amount of liquid remaining in the container. While the quantity of liquid left in a single container is small, the cumulative volume can be quite significant, when considering the large number of containers used to dispense chemicals in the laundry industry. In addition to the cost resulting from the loss of these chemicals, disposal of containers containing the chemicals into landfills and the like is environmentally undesirable and potentially hazardous to workers engaged in disposal of the containers.

Therefore, there is a need for an apparatus and method for ensuring substantially complete emptying of containers of liquids in which the liquids are removed from the containers with a probe or suction tube. There is especially a need for an apparatus of this type for automated removal of chemicals from a plurality of containers in dispensing of chemicals to commercial laundry machines. Other aspects of the invention will be apparent to one skilled in the art upon the reading of the following summary of the invention and the detailed description of the preferred embodiment.

SUMMARY OF THE INVENTION

Generally, the aspects of the present invention are achieved with a dispenser comprised of a container support for supporting one or more containers of liquid so that the container mouth is aligned over the lowest part of the container interior, a number of probes corresponding to the number of containers mounted above the mouth of the containers for insertion into the containers, and a probe support for holding the probes in the desired position. The dispenser also includes pumps in communication with the probes for withdrawing liquid from the containers through the probes and directing it to the desired destination. Preferably, the probes are positioned vertically above the mouths of the containers, and are moveable between raised and lowered positions.

In many instances, the containers will be blow molded plastic containers in the shape, for instance, of a conventional bleach jug. That is, a container or jug having a circular bottom wall, a continuous side wall extending upwardly from the outer edge of the bottom wall, and an upper wall extending inwardly from the upper edge of the side wall. The bottom wall will normally be of a concave configuration, at least in the central portion of the bottom wall, to increase its stability. The upper wall includes a mouth or opening normally centrally located, to provide access into the interior cavity of the container. A handle may also be formed in the container during molding. Since the container is blow-molded, the juncture of the bottom wall and the side wall will be curved.

Although containers normally used will be of this type, it will be obvious to one skilled in the art that the present invention is useful with other liquid containers, e.g., containers having the shape of a dram, or a bag-in-box container.

The container support may be a floor, preferably of a rectangular configuration with a width at least equal to the total diameters of the containers to be supported, and a depth at least equal to the diameter of one of the containers. The rear edge of the support floor will be positioned higher than the front edge of the support floor, i.e., the floor will be tilted toward the front edge so that containers resting on the support floor will be tilted toward the front. In this position, the mouth of the container will be vertically aligned over the lowermost part of the container, i.e., the juncture of the bottom and side walls of the container at the bottom of the tilted container. With containers such as the bag-in-box container, the floor may also be tilted to one side, i.e., one edge will be higher than the other to align the offset mouth of the bag-in-box container over the lowest part of the container.

The angle of inclination of the floor, i.e., the angle of the floor surface above horizontal, will vary depending upon the shape of the container to be emptied. Generally, however, the tilt angle of the floor will be from about 10 to about 30 degrees from horizontal. In order to ensure proper operation of the dispenser, the floor will be tilted such that the mouth of the container will be vertically above the lowermost point of the juncture between the bottom wall and the side wall of the container when the container is supported on the floor. Thus, the angle of inclination of the floor from horizontal will correspond to the angle from vertical of a line extending through the mouth of the container to the juncture of the bottom and side walls.

The present invention also contemplates a dispense in which the angle and shape of the floor can be changed to accommodate containers of different configurations. The floor can include container receiving recesses shaped to align the container at the desired attitude. The floor itself can be horizontal when using recessing with tilted bottoms. Other container supports adapted to support the container so that the container mouth is above the lowest part of the container interior will be apparent to one skilled in the art. For example, the containers may be positioned in a framework beneath the probes.

Each probe is comprised of a tubular member or pipe having upper and lower openings and a conduit extending between the openings. For reasons that will become hereinafter apparent, the lower or distal end of each tubular member has a convex curvature corresponding to the curvature of the juncture between the container's bottom and side walls. This may be achieved by capping the distal end of the tubular member with an end cap having an outer face with a curvature corresponding to the curvature of the juncture between the container bottom and side walls, and an opening or inlet extending from the face of the cap to the tubular conduit. In order to facilitate removal of liquid without air entering the probe, the end cap may also include one or more radial grooves extending from the outer edge of the cap to the inlet.

A closure such as a check valve or check ball is located in the tubular member at its distal end to prevent liquid from escaping from the probe back into the container. The check valve or ball should be located as close as possible to the bottom of the probe, since any liquid below the valve or ball will return to the container.

A probe support is also provided to correctly position the probe above the container. This probe support may be in the form of a vertical wall spaced above the tilted floor, with the probe being slidably positioned on the wall in a vertical position so that the probe can be moved down into the container interior or up to disengage from the container. The wall may, for example, include a vertical slot and the probe may include a connecting member or handle extending outwardly from the tubular member to project through the slot. The slot may also contain a probe lock, for example, in the form of a notch for engaging the handle when the probe is rotated, so that the probe can be locked in its upper, retracted position, e.g., for storage.

Preferably, the probe support wall will form the front wall of an enclosure or cabinet enclosing a plurality of pumps, e.g. peristaltic pumps, corresponding to the number of probes in the dispenser. Each pump will be in communication with the upper end of a probe to withdraw liquid from a container through the tubular member of the probe and direct it to a desired destination.

In order to use the dispenser, the containers to be emptied are positioned by the container support, e.g., the support floor, so that the containers are tilted toward the front of the dispenser with the container mouth being vertically aligned above the lowermost part of the container interior. In the case of a blow molded circular container, the lowest part of the interior will be at the concave juncture of the bottom and side walls of the container. The probe, initially in its uppermost position, is then moved downward to insert the lower end of the probe through the container opening and into the container interior until the distal end of the probe engages the wall of the container at its interior juncture. In this position, the curved end of the probe will rest against the curved interior juncture. The peristaltic pump is then activated to create a vacuum within the probe conduit drawing liquid from the container and up through the conduit by way of the radial grooves in the end cap and the cap inlet, and then through the tubular conduit. Since the radial grooves are positioned very close to the interior surface of the container at the lowermost point of the container interior, no significant air gap exists at the probe inlet. Thus, essentially all of the liquid can be drawn up into the probe. Once the pump is stopped, the closure prevents liquid from flowing out of the probe and back into the container. Therefore, as a result of the unique structure of the present invention, it is possible to remove essentially all of the liquid from the container.

After the container has been emptied, the probe is moved in an upward direction until the distal end of the probe is withdrawn from the container mouth. If desired, the probe can be locked in the uppermost position until it is again used. The empty container is then removed from the dispenser and appropriately discarded or recycled.

Other features of the invention will be apparent to one skilled in the art upon a reading of the detailed description of the invention which follows, taken together with the drawings. In the description, terms such as horizontal, upright, vertical, above, beneath, and the like, are used solely for the purpose of clarity in illustrating the invention, and should not be taken as words of limitation.

DETAILED DESCRIPTION OF THE PREFERRED EMBODIMENT

Figure 2:
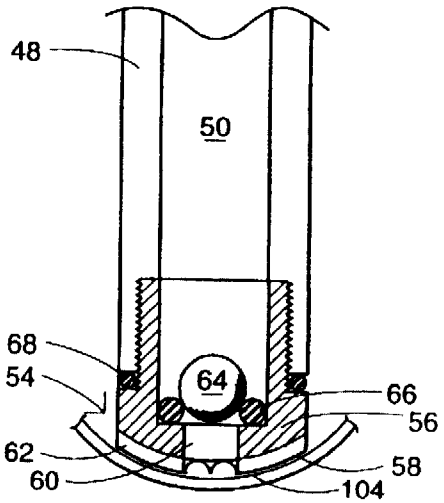
FIG. 2 is a cross-sectional side view of the distal end of the probe abutting a container interior.
Figure 3:
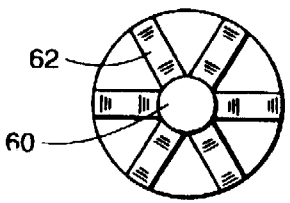
FIG. 3 is an end view of the probe end cap.
Figure 1:
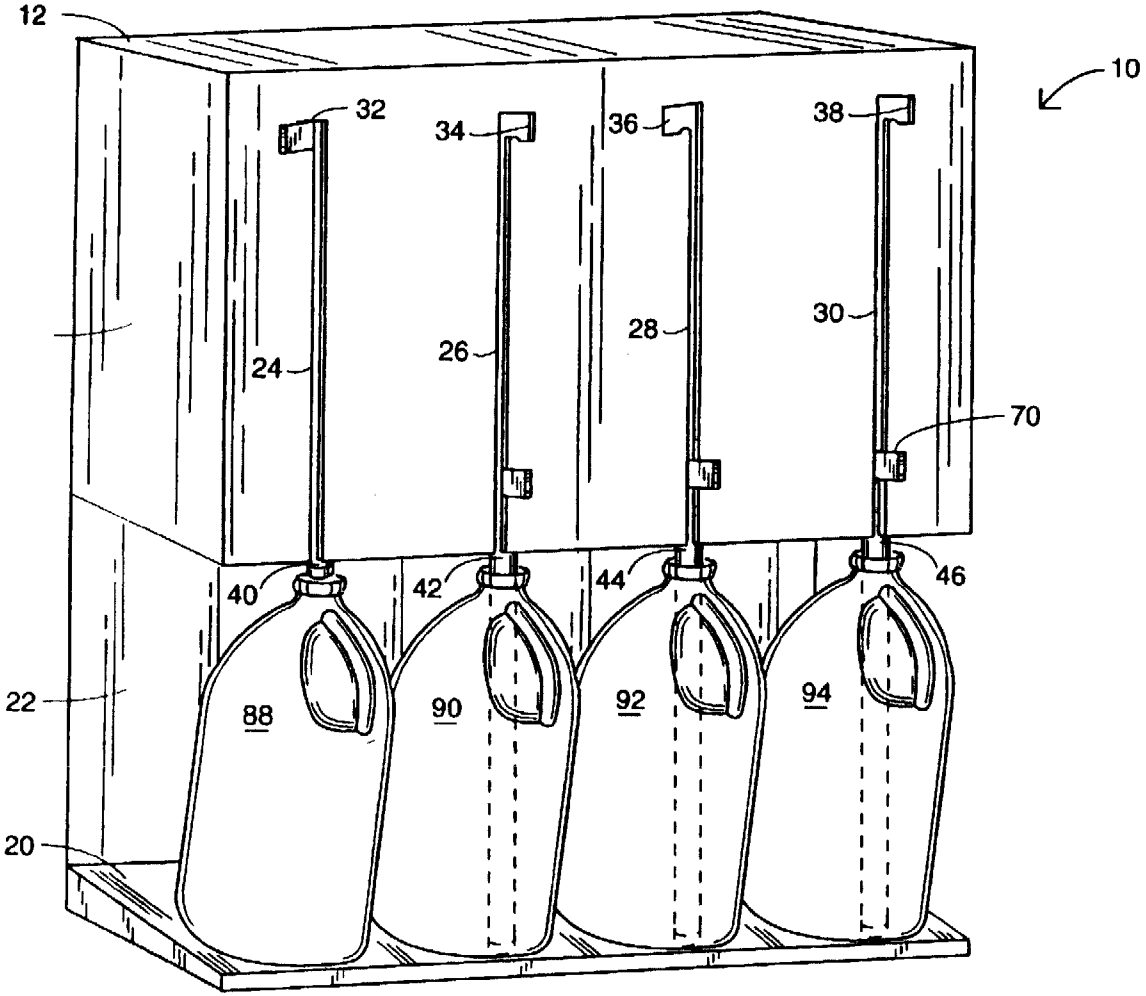
FIG. 1 is a perspective view of the dispenser.
Figure 5:
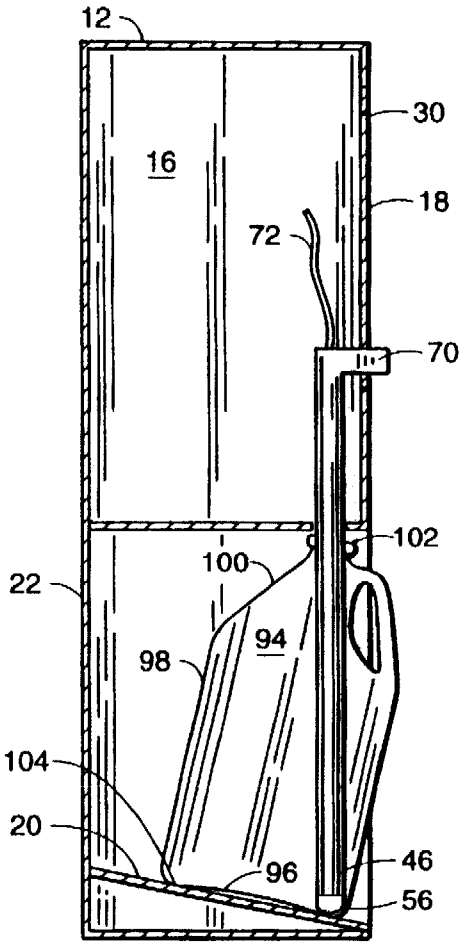
FIG. 5 is a sectional side view of the dispenser along line 5—5 of FIG. 4.
Figure 4:
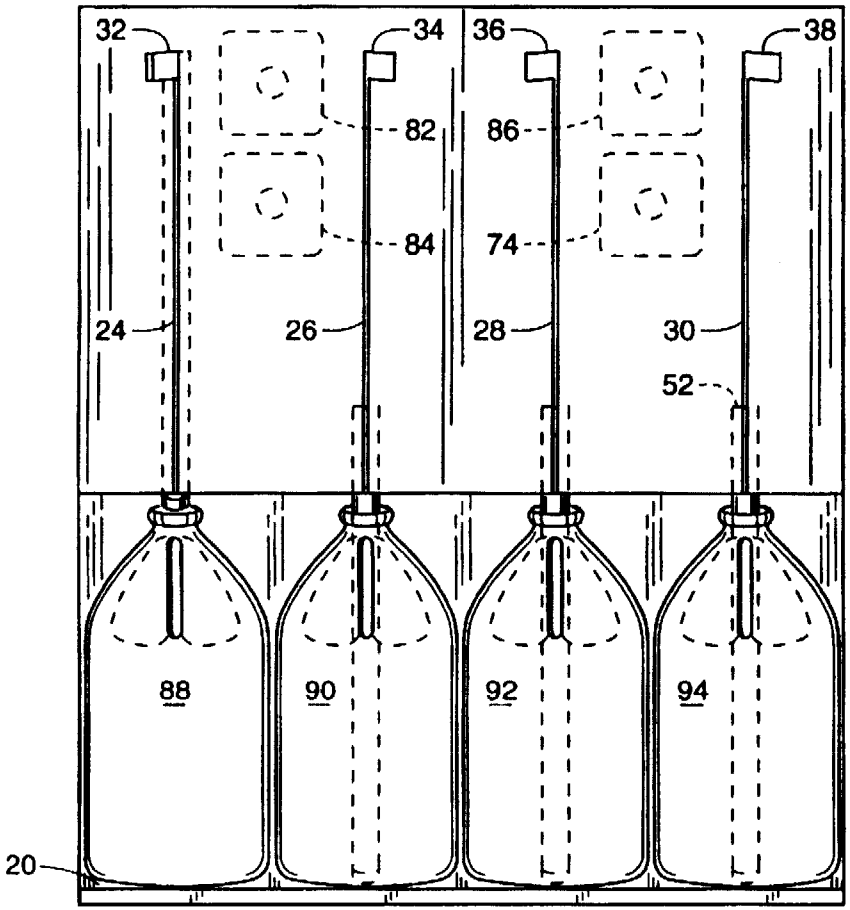
FIG. 4 is a front view of the dispenser with circular containers.

As best seen in FIGS. 1, 4 and 5, the preferred dispenser, shown with circular, blow molded containers, is comprised of an enclosure, generally 10, having a top wall 12, side walls 14 and 16, and a vertical front wall 18. A tilted container support surface or floor 20 is positioned beneath enclosure 10, which is supported a spaced distance above floor 20 by a back wall 22. Vertical front wall 18 includes four spaced vertical slots 24, 26, 28 and 30 extending from near the top of wall 18 to the bottom of wall 18. Slots 24–30 include horizontal notches 32, 34, 36 and 38, respectively, at their upper ends.

Extractor probes 40, 42, 44 and 46 are vertically positioned within enclosure 10 and slidable mounted on slots 24–30 for vertical movement between upper retracted and lower extended positions. All of the extractor probes are of the same construction. Probe 46 will be described in detail, it being understood that probes 40, 42 and 44 will include corresponding elements.

Probe 46 is comprised of a rigid vertical tube 48 having open upper and lower openings and a conduit 50 extending through the tube from an upper end 52 to a lower end 54. Lower end 54 of the robe 48 is capped with an end cap, generally 56, having a convex outer face 58. Face 58 includes a central opening 60 extending through cap 56 and into communication with conduit 50. End cap 56 also includes a plurality of horizontal radial grooves 62 extending from opening 60 to the outer edge of cap 56. A check ball 64 is positioned at the distal end of conduit 50 and rests on the inner end of opening 60 to prevent liquid from exiting through opening 60. O-rings 66 and 68 are used to prevent leakage.

Probe 46 also includes an outwardly projecting guide handle 70 extending horizontally from robe 48 through slot 30. In the upper retracted position, tube 48 can be rotated to secure handle into notch 38 to hold probe 46 in the upright retracted position, e.g., for storage when the probe is not in use. A flexible tube 72 extends from the upper end of probe 46 and into communication with peristaltic pump 74, used to draw liquid upwardly through probe 46. Other robes 76, 78 and 80 connect probes 40, 42 and 44 to pumps 82, 84 and 86, respectively.

Floor 20, tilted at an angle of 12° from the horizontal, supports four adjacent blow molded, liquid containers 88, 90, 92 and 94. Container 94 includes a convex, circular bottom wall 96, a continuous side wall 98 extending upwardly from the periphery of wall 96, and upper wall 100 extending upwardly and inwardly from the upper edge of side wall 98 to form a centrally located mouth 102. Juncture 104 of bottom wall 96 and side wall 98 is curved. Containers 88, 90, and 92 are of the same configuration as container 94. At the beginning of the dispensing process, the containers will be filled with liquids to be dispensed. However, liquid is not shown in the drawings for purposes of clarity.

In operation, as for example in dispensing liquids to one or more commercial laundry machines, containers 88, 90, 92 and 94, with the caps removed from their mouths, are positioned side-by-side on floor 20 beneath probes 40, 42, 44 and 46, respectively. As a result of the tilt of floor 20 and configuration of the containers, the mouths of the containers are vertically aligned over the lowermost point of the juncture between their bottom and side walls. For example, mouth 102 of container 94 is aligned over the lowermost point of juncture 104.

Each probe is initially in its uppermost retracted position. For example, probe 46 is held in its uppermost position by handle 70 engaging notch 38. Probe 46 is inserted into container 94 by rotating probe 46 to slide handle 70 downwardly in slot 30 moving the distal end 50 of probe 46 through mouth 102 and then further down into contact with the lowermost point of the interior of container 94 at the juncture of walls 96 and 98, where the outer face 58 of end cap 56 fits into the curvature of juncture 104. Probes 40, 42 and 44 are inserted into their respective containers in the same manner.

Peristaltic pump 74 then draws liquid into radial grooves 62 in end cap 56, opening 60 and conduit 50, and then to its destination, e.g., a washing machine, not shown. Pumps 82, 84 and 86 withdraw liquids from containers 88, 90 and 92 in the same manner.

When container 94 has been almost completely emptied, the last of the liquid will flow to the lowermost point of the container interior adjacent the distal end of probe 46. Since the outer face 58 of end cap 56 conforms to the curvature of the container at its lowermost point, and since radial grooves 62 are positioned immediately adjacent the interior surface of the container at this point, no significant air gap exists, resulting in essentially all of the liquid being drawn into probe 46. Check ball 64 prevents liquid from flowing back out of probe 46 into container 94 when pump 74 is stopped. When container 94 is empty, probe 46 is withdrawn by moving handle 70 upwardly along slot 30 until end 54 is above container mouth 102. Liquid is withdrawn from containers 88, 90 and 92 in a similar manner.

Figure 7:
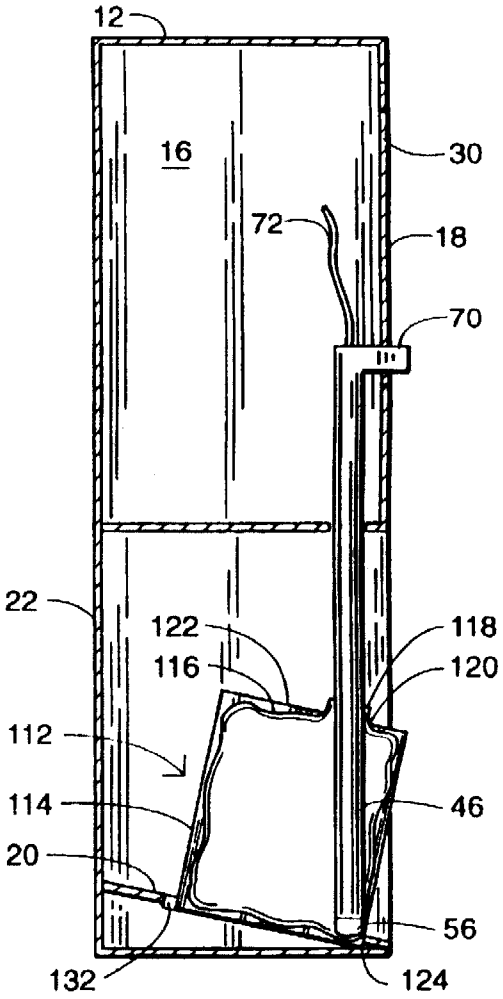
FIG. 7 is a sectional side view of the dispenser along line 7—7 of FIG. 6.
Figure 6:
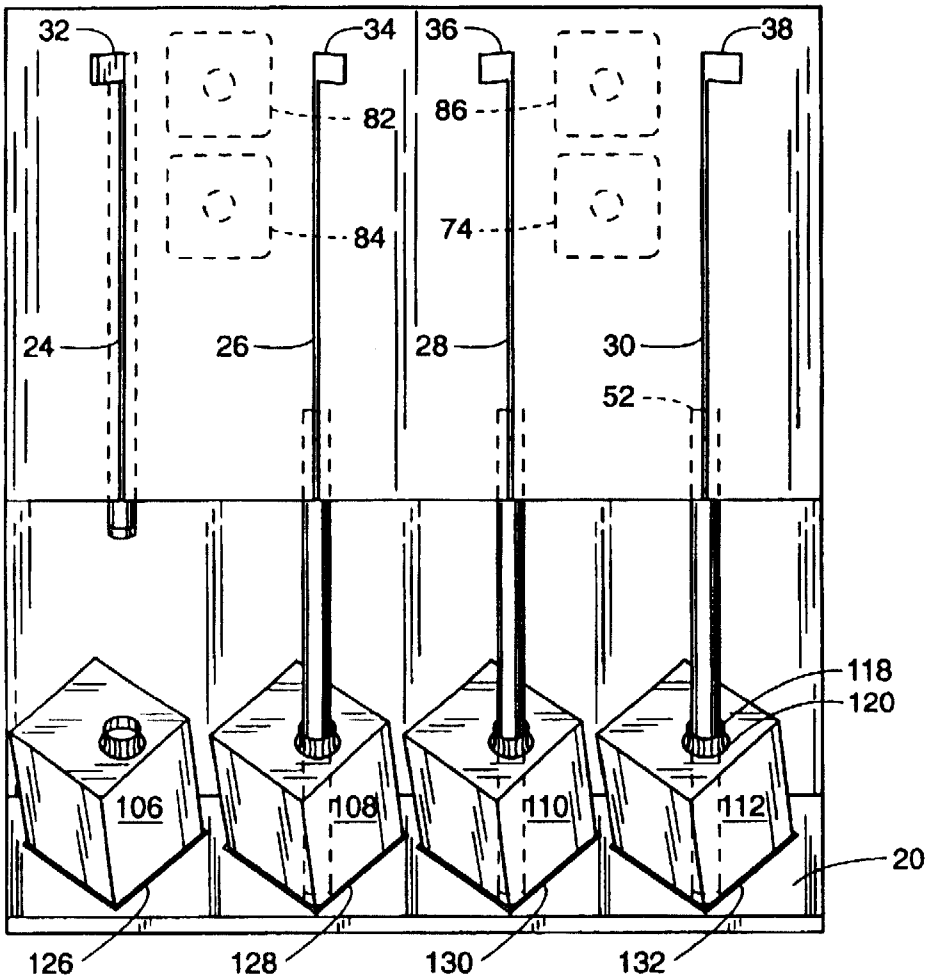
FIG. 6 is a front view of the dispenser with bag-in-box containers.

FIGS. 6 and 7 illustrate the dispense used to dispense liquids from bag-in-box containers 106, 108, 110 and 112. Taking container 112 as an example, it will be seen that container 112 is comprised of an outer box 114 and an inner liner 116 which includes a mouth 118 which projects through an opening 120 in box 114, which is offset from the center of container top 122. Therefore, container 112 must be tilted forward at an angle in this instance of 12° and also to one side at an angle in this instance of 5°, so that mouth 118 with be vertically aligned over the interior of lower corner 124. In this configuration, probe 46 can be inserted vertically down into the lowest part of container 112 to remove substantially all of the liquid. Alignment is achieved by modifying floor 20, so that it includes recesses 126, 128, 130 and 132.

Certain modifications and improvements will occur to those skilled in the art upon a reading of the foregoing description. By way of example, the curvature of the end cap of the probe can be of a different shape to conform to the juncture of containers of different shapes. Also, the probe can be inserted into a container at an angle where the configuration of the container is such that the probe reaches the lowermost point of the container interior, when it is desired to utilize the unique removal capabilities of the probe described herein. It should be understood that all such modifications and improvements have been deleted herein for the sake of conciseness and readability but are properly within the scope of the following claims.

What is claimed is:

1. A method of withdrawing substantially all of the liquid from a container having a mouth and bottom and at least one side wall joined at a curved juncture comprising:

a. positioning said container with said mouth vertically over said curved juncture;

b. slidable positioning a probe having a distal end above said mouth, said distal end having a curved outer face conforming to the shape of said curved juncture, said curved outer face having a centrally located inlet and an outer edge;

c. interconnecting said inlet and said outer edge with at least one radial groove along said curved outer face;

d. moving said probe downwardly through said mouth;

e. engaging said curved outer face with said curved juncture; and f. channeling liquid radially along said at least one groove from said outer edge to said centrally located inlet for withdrawal of liquid from said container upwardly through said probe.

2. The method of withdrawing liquid from a container as set forth in claim 1 including the steps of tilting said container and positioning said curved juncture vertically beneath said mouth.

* * * * *

UNITED STATES PATENT AND TRADEMARK OFFICE

CERTIFICATE OF CORRECTION

PATENT NO. : 5,743,432

DATED : April 28, 1998

INVENTOR(S) : David J. Barbe

It is certified that error appears in the above-identified patent and that said Letters Patent is hereby corrected as shown below:

Column 1, line 39, after "detergents" insert a comma (,). (PTO error)

Column 1, line 44, "rigid robe" should read --rigid tube--. (PTO error)

Column 2, line 57, after "opening" insert a comma (,). (PTO error)

Column 2, line 66, "dram" should read --drum--. (PTO error)

Column 4, lines 66-67, delete "along line 5-5". (PTO error)

Column 5, lines 3-4, delete "along line 7-7". (PTO error)

Column 5, line 16, "Slots 24-30" should read --Slots 24, 26, 28, and 30--. (PTO error)

Column 5, line 21, "24-30" should read --24, 26, 28, and 30--. (PTO error)

Column 5, line 29, "robe 48" should read --tube 48--. (PTO error)

Column 5, line 40, "robe 48" should read --tube 48--. (PTO error)

Column 5, line 46, "robes" should read --tube--. (PTO error)

Column 5, lines 46-47, "76, 78 and 80" should be deleted. (PTO error)

UNITED STATES PATENT AND TRADEMARK OFFICE

CERTIFICATE OF CORRECTION

PATENT NO. : 5,743,432
DATED : April 28, 1998
INVENTOR(S) : David J. Barbe

It is certified that error appears in the above-identified patent and that said Letters Patent is hereby corrected as shown below:

Column 6, line 34, "the dispense used" should read --the dispenser used--. (PTO error)

Column 6, line 43, "with" should read --will--. (PTO error)

Signed and Sealed this

Eighth Day of September, 1998

*Attest:*

*Attesting Officer*

Bruce Lehman

BRUCE LEHMAN

*Commissioner of Patents and Trademarks*